United States Patent [19]

Sintim-Damoa et al.

[11] 4,455,202

[45] Jun. 19, 1984

[54] ELECTROLYTIC PRODUCTION OF LITHIUM METAL

[75] Inventors: Kwame Sintim-Damoa; Srinivasa S. N. Reddy, both of Naperville; E. Scott McCormick, Batavia, all of Ill.

[73] Assignee: Standard Oil Company (Indiana), Chicago, Ill.

[21] Appl. No.: 404,316

[22] Filed: Aug. 2, 1982

[51] Int. Cl.[3] ..... C25C 3/02

[52] U.S. Cl. ..... 204/68

[58] Field of Search ..... 204/68

[56] References Cited

U.S. PATENT DOCUMENTS

| | | | |
|---|---|---|---|
| 3,344,049 | 9/1967 | Thieler et al. | 204/68 |
| 3,620,942 | 11/1971 | Day et al. | 204/68 |
| 4,181,584 | 1/1980 | Steiger et al. | 204/68 |

*Primary Examiner*—Howard S. Williams

*Attorney, Agent, or Firm*—Richard A. Kretchmer; William T. McClain; William H. Magidson

[57] ABSTRACT

Process for producing lithium by electroreduction of a lithium compound dispersed in a fused salt electrolyte and deposition of said electroreduced lithium in a liquid metal cathode from which said lithium is recovered.

21 Claims, No Drawings

ELECTROLYTIC PRODUCTION OF LITHIUM METAL

BACKGROUND OF THE INVENTION

This invention relates to a process for electrolytic production of lithium which comprises electroreducing a lithium compound in an electrolytic cell comprising a fused salt electrolyte, a lithium compound dispersed in said electrolyte, and a liquid metal cathode. More particularly, this invention relates to a process for electrolytic production of lithium which comprises electroreducing lithium oxide in an electrolytic cell comprising a fused salt electrolyte, lithium oxide dispersed in said electrolyte, and a liquid metal cathode.

The production of lithium is usually carried out by electrolysis of lithium compounds and deposition of the lithium at a solid cathode and evolution of a halide gas at the anode. Commercial electrolytic production of lithium is accomplished by electroreduction of a lithium halide in an electrolyte of lithium halide-alkali halide or other lithium compound (see, for example, Cooper et al., U.S. Pat. No. 4,156,635; Thieler, U.S. Pat. No. 3,344,049; Cook et al., U.S. Pat. No. 3,489,659; Hall, U.S. Pat. No. 3,826,721; and *Rare Metals Handbook*, 2d Edition, C. A. Hamper, editor, page 244, Krieger Pub. Co., Huntington, N.Y., 1971)). Typically electrolysis results in deposition of lithium at the solid cathode and evolution of chlorine gas at the anode. Although the commercial process is a well established method, it has several disadvantages such as: (1) the necessity of using high purity lithium halides, usually chlorides, as a feed material; (2) the electroreduced lithium rises to the top of the electrolyte, along with the evolved halogen gas, and the halogen gas has a tendency to recombine with the lithium unless great care is taken to prevent contact between the lithium and the halogen gas; (3) the evolved halogen gas must be recovered or absorbed rather than vented to the atmosphere; (4) along with lithium, impurities are codeposited at the solid cathode and three impurities are difficult to separate from the lithium; and (5) the lithium and alkali metal halides in the electrolyte are quite hygroscopic (particularly the chlorides), and the absorbed water in the halides reacts with the product lithium to form unwanted lithium oxide.

Gibson et at., U.S. Pat. No. 3,284, 325, and Gibson, Great Britain Patent No. 494,702, disclose the electrolytic production of alkaline earth metals using a liquid metal cathode to absorb the electroreduced alkaline earth metal. The liquid cathode enables separation of impurities from the desired alkaline earth metal, but the patentees disclose only an electrolyte containing potassium chloride and other alkali metal chlorides which are highly hygroscopic. Thus, the absorbed water reacts with the electroreduced alkaline earth metal to form unwanted oxides of the metal. Furthermore, these patents do not disclose either the use of lithium compounds or alkali metal compounds as feed materials or the application of the process to produce lithium or other alkali metals as the product.

Szechtman in U.S. Pat. No. 3,119,664 discloses an electrolytic process for producing alkali metal oxides. As part of this process the patentee discusses the electroreduction of potassium from fused potassium chloride and the use of a molten lead cathode to absorb the electroreduced potassium. Subsequently the alkali metal is separated and oxidized. However, the patentee does not disclose the production of lithium and uses only a chloride electrolyte which is highly hygroscopic. The patent also discloses electroreduction of alkali metal halide feed materials which are difficult and expensive to prepare in the case of lithium. Further, the electroreduction of halide salts results in evolution at the anode of unwanted halogen gases. Also, the salt undergoing electroreduction is a main component of the base electrolyte which requires the monitoring and balancing of electrolyte composition.

Since sodium and potassium are commonly found as chlorides, the prior art has been directed toward electroreduction of these chlorides to the alkali metal. However, lithium is not usually found as a choride, but rather as carbonate, which is easily converted to lithium oxide. Accordingly, there is a need for an electrolytic process to convert lithium carbonate, lithium oxide, or other common lithium compounds to elemental lithium.

The general object of this invention is to provide an improved electrolytic process for the production of lithium from lithium compounds. A more specific object of this invention is to provide a new electrolytic process for the production of lithium from lithium oxide. Other objects of the invention will be apparent to persons skilled in the art from the following description and appended claims.

For purposes of this invention, the phrase "dispersed in a fused salt electrolyte" comprises the physical suspension of the feed in the electrolyte as well as chemical dissolution in the electrolyte. The dispersion should be such that the material is capable of undergoing electroreduction and deposition of lithium at the cathode.

DESCRIPTION OF THE INVENTION

We have found that the objects of the invention can be obtained by an electrolytic process which comprises electroreducing a lithium compound in a cell comprising a liquid metal cathode and a fused salt electrolyte wherein said lithium compound comprises lithium and at least one member selected from the elements of the Periodic Table consisting of Group III A elements such as boron, Group IV A elements such as carbon, Group V A elements such as nitrogen, and Group VI A elements such as oxygen. The group designations are taken from the Periodic Table of Elements, Copyright 1968, Sargent-Welch Scientific Co. A preferred version of the invention comprises electroreducing lithium oxide dispersed in an electrolyte of fused lithium salts held in an electrolytic cell, and alloying said electroreduced lithium with a liquid metal cathode. Advantages of this invention are that lithium can be produced using relatively inexpensive and easily obtained feed materials, but without having to use hygroscopic feed materials or hygroscopic electrolytes; in addition the process avoids electroreduction of the base electrolyte and avoids evolution of halogen gases at the anode.

Briefly, the process of producing lithium from lithium compounds is carried out by electrolysis of lithium compound feed materials dispersed in a base electrolyte held in an electrolytic cell. The electrolytic cell anode is typically carbon, and the electrolyte is contained by a carbon container. The fused salt electrolyte contains the base electrolyte material, which preferably is not electroreduced, and a lithium compound intended to be electroreduced. During electroreduction the lithium is absorbed by a liquid metal cathode in the electrolytic cell, and the liquid alloy is processed by distillation or additional electroreduction to remove the desired lithium.

Certain initial general requirements should be fulfilled by the electrolytic cell including the following: The liquid metal cathode should be connected at some location to the external electrical circuit through the carbon container, however, the carbon container and electrolyte should be electrically insulated from one another. This electrical isolation is achievable by various means including: A boron nitride cylindrical cup can be used with a hole drilled through the bottom with the cup bonded to the inside of the carbon container. The liquid cathode then covers the bottom of the cup and fills the hole in contact with the carbon container. Alternatively, one can form a solidified crust of electrolyte material on the carbon container inner walls to act as an electrical insulation barrier between the fused electrolyte and carbon container. The electrolyte crust can be formed through cooling of the walls of the carbon container and by controlled cooling the crust thickness is capable of being varied to maintain the integrity of the crust and to attain the desired electrical insulating capacity. The liquid cathode at the bottom of the container does not have any electrolyte crust layer present and therefore electrically connects the carbon container below with the electrolyte bath above the liquid cathode.

Suitable electrolytes for this invention include, but are not limited to, the following alkali metal and alkaline earth metal compounds: chalcogenides such as $Li_2O$, $K_2O$, CaS, $Na_2S$, $K_2Se$, CaSe, or BaTe; fluorides such as LiF, NaF, KF, $CaF_2$, $BaF_2$, or $SrF_2$; hydroxides such as LiOH, NaOH, KOH, or $Ca(OH)_2$; sulfates such as $Li_2SO_4$, $Na_2SO_4$, $K_2SO_4$, or $SrSO_4$; nitrates such as $LiNO_3$, $NaNO_3$, $KNO_3$, or $Ca(NO_3)_2$; carbonates such as $Li_2CO_3$, $Na_2CO_3$, $K_2CO_3$, $CaCO_3$, or $SrCO_3$; and mixtures of all the preceding. The use of these and other appropriate compounds as fused salt electrolytes has the following requirements: (1) at the temperature of cell operation the cathode and the electrolyte are in the molten state (except for cases when an insulating electrolyte crust is formed as described in the previous paragraph) with the cathode material separated from the electrolyte and positioned at the bottom of the electrolyte; (2) the electrolyte must have the capability to accept a dispersion of feed material; (3) the relative characteristic decomposition potentials of the base electrolyte and lithium feed material preferably as such that the base electrolyte is not electroreduced; (4) the electrolyte should not prevent the forward reaction of electroreduction of the desired lithium and consequent deposition at the cathode; and (5) the electrolyte should not introduce certain undesirable impurites; for example, chlorides are highly hygroscopic, and the water will react with the electroreduced Li to cause formation of $Li_2O$.

A preferred electrolyte for production of lithium is a lithium compound/alkaline earth metal compound, the eutectic fluoride mixture of 80 mole percent lithium fluoride and 20 mole percent calcium fluoride, with a preferred temperature of operation of 750° to 900° C. The decomposition potential of lithium fluoride is 5.2 volts and for calcium fluoride is 5.4 volts, which may be compared with 2.17 volts for $Li_2O$ as the feed material. Another preferred electrolyte is the eutectic mixture of 26 mole percent lithium fluoride and 74 mole percent lithium carbonate, with a preferred operating temperature between 650° to 750° C.

The lithium compounds which are appropriate feed materials are compounds which form a stable dispersion in the base electrolyte and which are capable of being electroreduced to lithium. A lithium compound which is dispersed in a fused electrolyte is believed to be dissolved in the electrolyte although the term "dispersed" has been defined in this specification to include a physical suspension in the electrolyte. If the compound is dissolved, the lithium is present as cations in the base electrolyte along with the anion species of the compound and/or anion complexes formed with base electrolyte anions.

The electrolytic production of alkali metals as disclosed by Szechtman calls for the use of alkali halide feed materials, particularly chlorides, and the process also entails the electroreduction of the base electrolyte. The present invention overcomes disadvantages associated with the Szechtman process by the use of particular classes of lithium compound feed materials and base electrolyte and by avoiding electroreduction of the base electrolyte in the preferred mode of operation.

In the present invention the lithium feed material does not yield undesired products at the anode such as halogen gases which are present in the Szechtman process. Also, the feed material is not a halide, and any halides present in the base electrolyte are more electronegative-type compounds, such that electroreduction of the electrolyte does not occur. Therefore, no halogen gases are produced, and the base electrolyte composition does not change during cell operation. Furthermore, another advantage in not using lithium halide feed materials is the difficulty of producing lithium halides, unlike other alkali metal halides. The production of lithium halides requires one or more additional preparation steps requiring substantial energy input compared to $Li_2O$, LiOH, or $Li_2CO_3$ feed materials; thus, the feed material of the present invention is less expensive and more easily produced than if a lithium halide feed material were used as taught in Szechtman. Also, most halides, particularly the chlorides, tend to be quite hygroscopic which causes backreaction of lithium with the absorbed water to form $Li_2O$. Finally, in this invention some degree of codeposition at the cathode of contaminant materials, as well as lithium, is permissible since separation by distillation or further electrolysis of the product lithium deposited in the liquid cathode permits selective removal of the desired lithium.

Although not an exhaustive list, typical compounds capable of being utilized as feed materials comprise the following lithium compounds: chalcogenides such as $Li_2O$, $Li_2S$, $Li_2Se$, or $Li_2Te$; sulfates such as $Li_2SO_4$; hydroxides such as LiOH; carbonates such as $Li_2CO_3$ or $LiHCO_3$ bicarbonate; silicates such as $Li_4SiO_4$ or $Li_2SiO_3$; nitrates such as $LiNO_3$; phosphates such as $Li_3PO_4$; borates such as $LiBO_2$ metaborate; aluminates such as $Li_2Al_2O_4$; the lithium oxide type minerals spodumene ($LiAlSi_2O_6$), petalite ($LiAlSi_4O_{10}$), lepidolite (mica with 3-4 weight percent $Li_2O$), hectorite which is a smectite clay of composition $Na_{0.33}(Mg, Li)_3Si_4O_{10}(F,OH)_2$; and mixtures of the preceding. Spodumene has a $Li_2O$ content of about 8 weight percent, petalite has a $Li_2O$ content of approximately 4.9 weight percent, lepidolite contains about 3 to 4 weight percent $Li_2O$, and hectorite has from 0.7 to 1.3 weight percent $Li_2O$.

In the mixture of base electrolyte and feed material, the lithium compounds discussed above can act either as feed material and/or base electrolyte; however, if intended as the feed material, then that particular lithium compound is the preferred source of lithium deposited at the cathode. Therefore, in the electrolytic cell the most easily electroreduced lithium compounds will be the source for deposition of lithium at the cathode, while less readily electroreduced lithium compounds will form the base electrolyte. For example, lithium fluoride is the lithium compound which is the most difficult to electroreduce. Lithium fluoride will not be the source of lithium at the cathode if the cell potential is not large enough to electroreduce lithium flouride and other lithium compounds are present (such as $Li_2O$, LiOH, or $Li_2CO_3$) for which the characteristic electroreduction potential has been exceeded by the cell potential.

Lithium chalcogenides, particularly the oxides such as $Li_2O$ or the mineral spodumene, are a preferred source of lithium in this invention. $Li_2O$ is produced readily from lithium carbonate (the common form of lithium) by thermal decomposition at 1310° C. to $Li_2O$ and $CO_2$. $Li_2O$ has a solubility of about 10 percent by weight in a preferred lithium fluoridecalcium fluoride electrolyte. The theoretical characteristic reduction potential for $Li_2O$ is 2.17 volts, but a preferred commercial cell operating voltage is 4 to 5 volts for this system. A voltage larger than 2.17 volts is preferred due to electrolyte resistance, overpotential at the anode and cathode, and general circuit resistance in the wiring and other components of the cell.

It is possible to deposit materials at the cathode other than the desired metal if a large concentration gradient of a contaminant material is formed in the electrolyte at the electrolyte-cathode interface. The necessary potential, E, to deposit such a material in the cathode is, $$E=E^o-(RT/nF)(\ln a_i)$$

where $E^o$=the standard decomposition potential of the material;

R=the universal gas constant;

T=temperature in degrees Kelvin;

n=the number of electrons transferred for each molecular formula unit of the material to be electroreduced;

F=the Faraday constant;

$a_i=\gamma c_i$;

$\gamma^i$=the activity coefficient; and $c_i$=the concentration of the species.

Thus, if $c_i$ is large enough, the cell voltage may not exceed $E^o$ but can exceed E, and the material is then electrodeposited at the cathode. The presence of this additional material does not lead to difficulties in the present invention since the additional material may be readily separated from the desired lithium metal either by distillation or further electroreduction treatment of the liquid cathode as discussed previously.

Appropriate cathode materials for this invention comprise: tin, lead, copper, cadmium, bismuth, indium, thalium, zinc, calcium, aluminum, antimony, silver, gold, germanium, silicon, tellurium, magnesium, gallium, and mixtures thereof. The use of one or more of these elements or mixtures is restricted in part by the composition and operating temperature of the electrolyte bath. The cathode density must be greater than the electrolyte to keep the cathode at the bottom of the cell; the cell operating temperature preferably is above the electrolyte and cathode melting points, but not at or above the boiling points; the cathode metal and electrolyte should be relatively insoluble in one another, and the cathode should not be chemically reactive with the electrolyte. The cathode material should also have sufficient solubility for the electroreduced lithium to absorb the lithium once electroreduction has taken place. In the production of lithium from lithium oxide, 80 mole percent lithium fluoride and 20 mole percent calcium fluoride is one preferred electrolyte and has a density of 2.22 grams/cc. A preferred liquid cathode is tin with a density of 7.30 grams/cc.

The anode is carbon, an inert noble metal such as platinum, or a conducting ceramic material; but carbon is the preferred material since carbon is inexpensive relative to the noble metals and ceramics. Similarly the electrolytic cell vessel is carbon, a noble metal, or other inert material, but is preferably carbon.

The electrolytic cell, described in detail above, has a maximum operating temperature of approximately 1300° C. Cathode materials are utilized which are compatible with the containment vessel, with the temperature of operation, and with the choice of electrolyte and feed material. Electrolytic cell voltages necessary for electroreduction of lithium compound feed materials can range as high as 10 to 15 volts, depending primarily on the feed material and the base electrolyte being used. In this invention the base electrolyte preferably acts only as a medium for electroreduction of the feed material, the base electrolyte not usually undergoing electroreduction. Therefore, provided the characteristic electroreduction potential of the base electrolyte is not exceeded, only the feed material undergoes electroreduction. Consequently, very little monitoring of base electrolyte composition is necessary, and only the feed material input and concentration need be monitored. Electrical current levels are dictated by the size of the cell operation and by the basic electrochemical electroreduction charge requirements for the feed material. The process can either be batch or continuous in nature depending on whether the consumable carbon anode can be continuously fed to the electrolyte. With a continuous anode, cell operation is virtually uninterrupted with cathode material periodically removed and fresh cathode material introduced as the lithium concentration increases in the cathode. Typically the cathode should be removed as the lithium concentration reaches about 25 atom percent with the maximum concentration dictated by the boiling point of the alloyed cathode material and the density of the cathode. The lithium is separated from the cathode alloy by further electroreduction or by distillation as described by Gibson et al., in U.S. Pat. No. 3,284,325 which is incorporated by reference.

EXAMPLE

The electrolytic cell container was composed of a graphite crucible with a 5-centimeter inside diameter. This crucible had a boron nitride inner cylindrical liner with a 4-centimeter inside diameter and a bottom plate with a 1-centimeter diameter hole leading to the bottom of the graphite crucible. Fifty grams of mossy tin metal was placed both at the bottom of the crucible as well as within the 1-centimeter diameter hole at the bottom of the boron nitride sleeve. The crucible containing the tin was then placed in a furnace, heated to 1,200° C. over a two-hour period, and cooled to room temperature over a four-hour period. A constant flow of argon gas at 5 liters/minute was maintained during the heating cycle.

Eighty-five grams of lithium fluoride, 65 grams of calcium fluoride, and 18 grams of lithium oxide were thoroughly mixed and pressed into pellets under 18,000 psi pressure in a 3-inch diameter die set. These pressed pellets were placed on top of the layer of tin which had solidified at the bottom of the boron-nitride-lined crucible. The crucible was then placed in a cylindrical inconel vessel 6.5 centimeters in diameter, 45 centimeters in height, and the vessel was placed within a resistance heated furnace. The top of the inconel vessel was covered with an inconel plate to provide a tightly sealed vessel. This cover plate had an inlet and outlet port for inert gases and a hole for admission of a thermocouple. The center of the inconel vessel accepted a stainless steel rod and a graphite rod, 15 centimeters by 2 centimeters in diameter, and the graphite rod was attached to the end of the stainless steel rod. This graphite rod served as the anode for the electrolytic cell and could be lowered or raised by a gear mechanism attached to the stainless steel rod outside the inconel vessel. The inconel vessel was evacuated and a steady flow of 8 liters/minute of argon gas was admitted. The entire vessel was heated to 900° C. to melt the $LiF-CaF_2$ electrolyte, the $Li_2O$ feed material, and cathode metal; and the vessel was held at this temperature during the electrolytic process. The tin cathode was in electrical contact with the graphite crucible by means of the liquid tin metal filling the hole in the bottom of the boron nitride insulating sleeve.

Electrical connections were made to an electrical power source, a volt meter, and an ammeter. The anode was lowered into the molten electrolyte approximately 1 centimeter to complete the electrical circuit. The electrolytic cell was operated for 7.33 hours at a constant current of 4.025 amperes and an initial cell voltage of 2.385 volts. The voltage was allowed to fluctuate and was measured on a strip chart recorder. When the voltage increased more than 0.2 volts, the anode was lowered 1 centimeter into the electrolyte to compensate for the consumption of the anode by the reaction with the oxygen gas evolved at the anode. The initial voltage of 2.39 volts remained constant within 0.05 volts for a period of 5 hours and then began to drift upward necessitating lowering of the anode. The operating voltage was 3.45 volts after 7 hours of operation. The electrolytic process was terminated when the lithium oxide feed material was depleted as measured by a rapid increase in cell voltage to 15 volts after 7.33 hours of operation. The furnace was then cooled to room temperature, the liquid cathode was removed, and the alloy composition analyzed. A total of 47.79 grams of alloy were recovered, and several grams were not recovered in order to avoid withdrawing part of the electrolyte at the liquid cathode-electrolyte interface. The alloy composition was determined to be 2.96 percent lithium metal. The current efficiency was determined to be 19.8 percent. This is relatively low efficiency, but no attempt was made to optimize power usage. Expected efficiencies are in excess of 80 percent.

We claim:

1. A process for electrolytic production of lithium which comprises electroreducing a lithium compound in a cell comprising a liquid metal cathode and a fused salt electrolyte wherein said lithium compound is dispersed in said fused salt electrolyte and is selected from the group consisting of lithium oxide, lithium hydroxide, lithium carbonate, spodumene, petalite, and lepidolite, and said liquid metal cathode is of greater density than said fused salt electrolyte.

2. The process of claim 1 wherein said fused salt electrolyte comprises a fluoride compound.

3. The process of claim 1 wherein said liquid metal cathode comprises at least one member selected from the group consisting of tin, lead, copper, cadmium, bismuth, indium, thalium, zinc, calcium, aluminum, antimony, silver, gold, germanium, silicon, tellurium, magnesium, and gallium.

4. The process of claim 1 wherein said fused salt electrolyte comprises at least one member selected from the group consisting of alkali metal compounds and alkaline earth metal compounds.

5. The process of claim 4 wherein said fused salt electrolyte comprises a fluoride salt.

6. The process of claim 4 wherein said fused salt electrolyte comprises a compound having at least one anion member selected from the group consisting of Group III A elements, Group IV A elements, Group V A elements, and Group VI A elements.

7. The process of claim 1 wherein said lithium metal compound is selected from the group consisting of lithium oxide, spodumene, petalite, and lepidolite.

8. The process of claim 7 wherein said fused salt electrolyte comprises a compound of lithium having at least one anion member selected from the group consisting of fluorine and carbonate.

9. The process of claim 8 wherein said fused salt electrolyte comprises lithium fluoride and lithium carbonate.

10. The process of claim 9 wherein said fused salt electrolyte is the eutectic mixture of lithium fluoride and lithium carbonate.

11. The process of claim 7 wherein said fused salt electrolyte is a mixture of lithium fluoride and calcium fluoride.

12. The process of claim 11 wherein said fused salt electrolyte is the eutectic mixture of lithium fluoride and calcium fluoride.

13. A process for electrolytic production of lithium which comprises electroreducing lithium oxide in a cell comprising a liquid metal cathode and a fused salt electrolyte wherein said lithium oxide is dispersed in said fused salt electrolyte and said liquid metal cathode is of greater density than said fused salt electrolyte.

14. The process of claim 13 wherein said fused salt electrolyte comprises at least one member selected from the group consisting of lithium fluoride and calcium fluoride.

15. The process of claim 14 wherein said fused salt electrolyte is a mixture of lithium fluoride and calcium fluoride.

16. A process for the electrolytic production of lithium which comprises electroreducing a lithium compound in the presence of a fused salt electrolyte within an electrolytic cell wherein said lithium compound is selected from the group consisting of lithium oxide, lithium hydroxide, lithium carbonate, spodumene, petalite, and lepidolite, and wherein said cell comprises:

(a) an electrically conducting vessel adapted to contain said lithium compound and said fused salt electrolyte;

(b) a liquid metal cathode at the bottom of, and in electrical contact with said vessel; and (c) an electrically insulating layer of solidified electrolyte on the inside walls of said vessel.

17. The process of claim 16 wherein said fused salt electrolyte is at least one member selected from the group consisting of lithium carbonate, lithium fluoride, and calcium fluoride.

18. The process of claim 16 wherein said lithium compound is selected from the group consisting of lithium oxide, spodumene, petalite, and lepidolite.

19. The process of claim 18 wherein said lithium compound is lithium oxide.

20. The process of claim 19 wherein said fused salt electrolyte comprises at least one member selected from the group consisting of lithium fluoride and calcium fluoride.

21. The process of claim 20 wherein said fused salt electrolyte is a mixture of lithium fluoride and calcium fluoride.

* * * * *